US010550602B2

(12) United States Patent
Boutelegier

(10) Patent No.: US 10,550,602 B2
(45) Date of Patent: Feb. 4, 2020

(54) LOCKING DEVICE COMPRISING A DEACTIVATION MECHANISM

(71) Applicant: 9DESIGN.BE BVBA, Wilrijk (BE)

(72) Inventor: Roel Boutelegier, Antwerp (BE)

(73) Assignee: 9DESIGN.BE BVBA, Wilrijk (BE)

( * ) Notice: Subject to any disclaimer, the term of this patent is extended or adjusted under 35 U.S.C. 154(b) by 1258 days.

(21) Appl. No.: 14/411,448

(22) PCT Filed: Jun. 26, 2013

(86) PCT No.: PCT/EP2013/063440
§ 371 (c)(1),
(2) Date: Dec. 26, 2014

(87) PCT Pub. No.: WO2014/001415
PCT Pub. Date: Jan. 3, 2014

(65) Prior Publication Data

US 2015/0204110 A1 Jul. 23, 2015

(30) Foreign Application Priority Data

Jun. 26, 2012 (EP) ..... 12173635

(51) Int. Cl.
*E05B 47/00* (2006.01)

(52) U.S. Cl.
CPC ..... *E05B 47/0001* (2013.01); *E05B 47/0002* (2013.01); *E05B 47/0012* (2013.01); *E05B 47/0038* (2013.01); *Y10T 292/1014* (2015.04)

(58) Field of Classification Search
CPC ..... Y10T 292/0999; Y10T 292/1003; Y10T 292/1021; Y10T 292/175; Y10T 292/18;
(Continued)

(56) References Cited

U.S. PATENT DOCUMENTS 2,765,648 A * 10/1956 Hatcher ..... E05L 347/00 292/144
6,481,158 B1 * 11/2002 Marks ..... H04L 29/06 292/177

(Continued)

FOREIGN PATENT DOCUMENTS

EP 0 021 670 1/1981
EP 1 580 359 9/2005

(Continued)

*Primary Examiner* — Alyson M Merlino
(74) *Attorney, Agent, or Firm* — Levy & Grandinetti

(57) ABSTRACT

A locking device is disclosed having (a) a tubular housing having a frontal end and a distal end; (b) a latch movable between a first position protruding from the frontal end of the housing and a second position wherein the latch is retracted in the housing; and (c) an electrically driven drive device for moving the latch between the first and second positions. The locking device further includes a deactivation mechanism provided in the housing and allowing movement of the drive device or at least part thereof from an active position wherein the drive device is enabled to move the latch between the first and second position and an inactive position wherein the latch is retracted in the housing irrespective of its movement by the electrical drive device.

18 Claims, 2 Drawing Sheets

(58) Field of Classification Search
CPC ..... Y10T 292/54; Y10T 292/558; Y10T 70/7051; Y10T 70/7062; Y10T 70/7102; Y10T 70/7113; Y10T 70/713; Y10T 70/7119; E05B 63/0073; E05B 47/0001; E05B 47/0012; E05B 47/06; E05B 47/0607; E05B 47/00; E05B 47/0002; E05B 47/0038; E05B 47/026; E05B 2047/0067; E05B 2047/0068; E05B 2047/0076; Y10S 292/65; Y10S 292/24; Y10S 292/26; Y10S 70/06; Y10S 70/80
See application file for complete search history.

(56) References Cited

U.S. PATENT DOCUMENTS

| | | | | |
|---|---|---|---|---|
| 7,052,054 | B2 * | 5/2006 | Luker | E05B 47/0012 292/199 |
| 8,851,530 | B2 * | 10/2014 | Geringer | E05B 47/0012 292/144 |
| 2004/0070218 | A1 * | 4/2004 | Smith | E05C 19/18 292/339 |
| 2004/0187532 | A1 * | 9/2004 | Hsieh | E05B 47/0012 70/256 |

FOREIGN PATENT DOCUMENTS

| | | |
|---|---|---|
| FR | 2 653 480 | 4/1991 |
| FR | 2 879 643 | 6/2006 |
| WO | WO 87/04213 | 7/1987 |
| WO | WO 2008/094039 | 8/2008 |

* cited by examiner

LOCKING DEVICE COMPRISING A DEACTIVATION MECHANISM

This Application is the U.S. National Phase of International Application Number PCT/EP2013/063440 filed on Jun. 26, 2013, which claims priority to European Application Number 12173635.9 filed on Jun. 26, 2012.

FIELD OF THE INVENTION

The present invention concerns an electrically driven fail-safe locking device comprising with a tubular housing.

BACKGROUND OF THE INVENTION

With an increasing interest for access control plans and series of locking devices comprised therein, there is a market demand for easy to install locking devices that are operable both mechanically and electronically, without jeopardizing safety, both in terms of theft-prevention and automatically unlocking (fail-safe) in case of fire or other in-house threads.

FR 2,653,480 discloses a fail-safe locking device for emergency exits, the locking device comprising an electromagnet to maintain a latch in a closed position. When power supply to the electromagnet is interrupted, the latch is retracted in to the housing of the locking device by means of a spring. An electro-motor is provided for moving the latch to a closed position of the locking device after power supply is recovered.

A drawback of the locking device according to FR 2,653,480 is that it does not allow controlled opening and closing of the locking device without interrupting the current first and consecutively recovering power supply to the electromagnet and electro-motor.

A serious disadvantage of the locking device according to FR 2,653,480 is that in case power supply is interrupted while the electro-motor is moving the latch in a closed position, the fail-safe mechanism will fail to open the locking device for the reason that the electro-motor needs to be decoupled from a spindle actuating the latch first. As such it is clear that this locking device is not applicable for access control to access points that need to open and close on a regular basis.

WO 2008/094039 discloses a fail-safe locking device that will always open upon interruption of the power supply.

This locking device however has the drawback that it does not allow for a latch to be driven in a longitudinal direction of the housing and requires several holes to be provided in a door for placing the lock. Hence installation is cumbersome and the flexibility as to choose the position of the lock in a door is limited.

WO 87/04213, EP 0021670 and FR 2879643 disclose locking devices comprising drive means allowing moving a latch between a first position protruding from a frontal end of the lock housing and a second position wherein the latch is retracted in the housing; and further comprising a deactivation mechanism allowing movement of the drive means from an active position wherein the drive means are enabled to move the latch between the first and second position and a inactive position wherein the latch is retracted in the housing irrespective of its movement by the electrical drive means. The disclosed locking devices however have the disadvantage that the deactivation mechanism to be operated mechanically and will only be activated either manually or by activation of a alarming system. This may result in dangerous situations in case power supply is interrupted and no alarm is generated.

It is clear from the above that there remains a need for easy to install, versatile and reliable fail-safe locking devices.

SUMMARY OF THE INVENTION

The present invention addresses the above drawbacks by providing a versatile, easy to install and reliable locking device. The locking device according to the present invention comprises:

(a) a tubular housing having a frontal end and a distal end;

(b) a latch movable between a first position protruding from the frontal end of the housing and a second position wherein the latch is retracted in the housing;

(c) electrically driven drive means for moving the latch between said first and second positions wherein said locking device further comprises a deactivation mechanism provided in said housing and allowing movement of the drive means or at least part thereof from an active position wherein the drive means are enabled to move the latch between the first and second position and a inactive position wherein the latch is retracted in the housing irrespective of its movement by the electrical drive means.

The deactivation mechanism is preferably electrically driven and preferably comprises a mechanical actuator for moving the drive means or part thereof.

DETAILED DESCRIPTION OF PREFERRED EMBODIMENTS

Figure 1A:
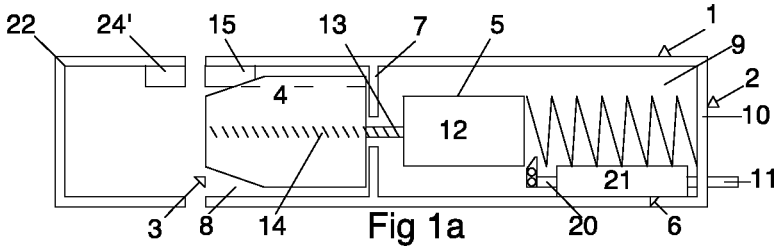
FIGS. 1A-1C schematically represents a first embodiment of a locking device according to the present invention in several positions of the locking device
Figure 1B:
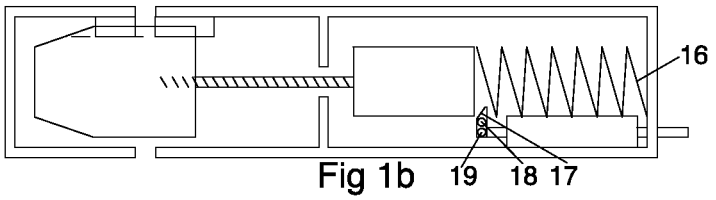

FIG. 1 represents a locking device with a tubular housing 1 having a distal end 2 and a frontal end 3. A latch 4 is movable between a first position protruding from the frontal end of the housing (FIG. 1*b*) and a second position retracted in the housing (FIG. 1*a*). Inside the housing, electrical drive means 5 are provided for moving the latch between said first and second positions.

According to the present invention a deactivation mechanism 6 is provided in the housing, allowing movement of the drive means 5 or at least part thereof from an active position (FIGS. 1*a* & *b*) wherein the drive means are enabled to move the latch 4 between the first and second position and a inactive position (FIG. 1*c*) wherein the latch 4 is retracted in the housing irrespective of its movement by the electrical drive means.

The housing 1 is preferably made in a rigid material such as steel or aluminum and preferably has a length of no more than 20 cm, preferably no more than 15 cm and a diameter of maximally 4 cm, preferably maximally 3 cm, most preferably a diameter of maximally 2.5 cm.

A rim 7 is provided inside the housing dividing the inner space in the housing in a frontal compartment 8 accommodating the latch 4 and a distal compartment 9 accommodating the deactivation mechanism 6. Preferably a longitudinally extending groove is provided in the inner surface of the housing in said frontal compartment 8.

At the distal end 3, in particular a distal end plate 10 of the housing several connectors 11 are provided allowing external supply of power to the drive means 5 and deactivation mechanism 6. Control of the drive means 5 is preferably achieved by a control unit comprising a printed circuit board and a memory provided in the housing (not depicted).

The drive means 5 in this case comprise an electromotor 12, the outgoing ax of which is coupled to a spindle 13 extending axially in the housing, through a hole defined by the inner edge of rim 7.

The latch 4 is provided with an threaded hole 14 cooperating with the free end of the spindle 13. The latch further preferably comprises an externally directed protrusion 15 cooperating with the above mentioned groove in the frontal compartment of the housing, thereby preventing rotation of the latch 4 in view of the housing 1.

The deactivation mechanism in this case comprises a spring 16 and a blocking pawl 17. The spring is fixed with one end to the electromotor 12 and with the other end to the distal end plate 10 of the housing, thereby biasing the drive means 5 towards the distal end 2 of the housing 1.

The blocking pawl 17 is positioned to maintain the drive means 5 in an active position against the force exerted by the spring 16 and is mounted pivoting around an axes 18 fixed in the housing. A second axes 19 provided in said pawl is fixed to the free end of a rod 20 extending longitudinally in said housing and movable in the axial direction by a solenoid 21 electrically powered through a connector 11.

The functioning of the locking device is rather simple and straight-forward. FIG. 1*a* represents the locking device in an active open position, whereby the latch is retracted in the housing and the drive means are maintained in an active position by pawl 17. In this position, the solenoid 21 is electrically powered.

By activation of the drive means, the spindle 13 is rotated and the latch is forced out of the housing to a closed position of the locking device. By driving the electromotor in an opposite sense, the spindle is winds itself inside the latch, thereby retracting the latch inside the housing.

Figure 1C:
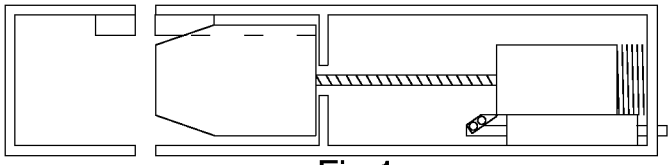

When the locking device is in a closed position and a power interruption occurs, the is forced to move towards the frontal end of the housing by the solenoid, thereby pivoting the pawl 17 and releasing the drive means 5 which is retracted in a distal (second) position under the force of spring 16. The movement of the drive means in a distal position will automatically retract the latch in an open position of the locking device as shown in FIG. 1*c*.

To reactivate the lock, the drive means 5 need to be actuated such that the electromotor winds itself on the spindle against the force of spring 16 into its active position. Meanwhile power supply to the deactivation mechanism is restored and the pawl 17 will maintain the drive means 5 in the active position. The locking device is now open with the latch retreated in the housing as shown in FIG. 1*a*.

It is noted that the deactivation mechanism can also be actuated by means of a mechanical movement of rod 20 (in this case pushing it towards the frontal end of the housing). Therefore rod 20 preferably protrudes from the distal end of the housing.

Figure 2A:
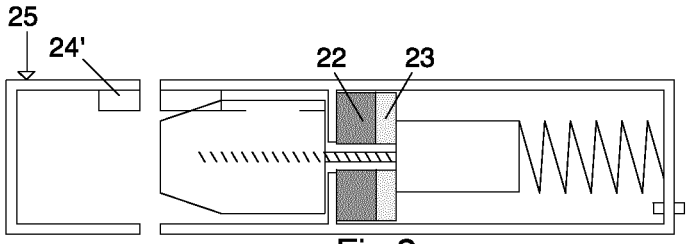
FIGS. 2A-2C and 3A-3C represent alternative embodiments of the locking device of FIGS. 1A-1C in similar positions thereof.
Figure 2B:
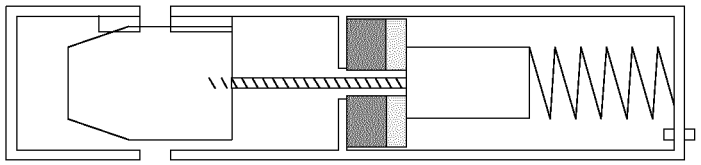
Figure 2C:
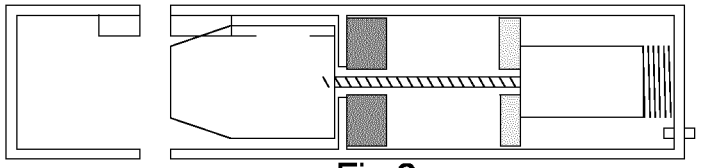

FIGS. 2*a-c* represent an alternative embodiment of the locking device according to the present invention, wherein the solenoid of the deactivation mechanism in the above embodiment is replaced by an electromagnet 22 fixed on the distal surface of rim 7 and a permanent magnet 23 on the distal surface of which the electromotor 12 is fixed. When power is supplied to the electromagnet, the permanent magnet 23 and the electromotor are maintained frontally in the distal compartment 8, whereas in case of interruption of the power supply, the electromotor 12 and permanent magnet 23 are retracted by spring 16 in an inactive position of the drive means towards the distal end of the distal compartment 8.

Clearly the permanent magnet and electromagnet can be switched mutually without changing the functioning of the locking device.

Figure 3A:
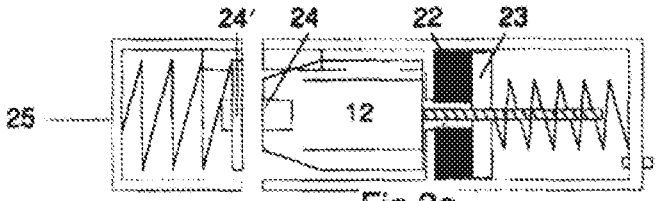
Figure 3B:
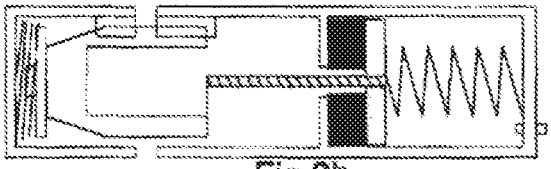
Figure 3C:
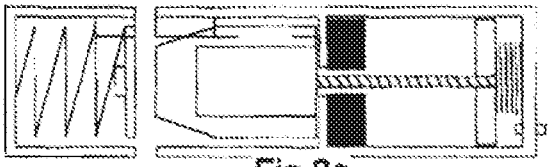

FIGS. 3*a-c* represent a third embodiment of a locking device according to the present invention wherein the electromotor 12 of the drive means is incorporated in the latch 4 and where the deactivation mechanism comprises an electromagnet 22 and a permanent magnet 23 that is movable in the housing and comprises a threaded hole cooperating with the spindle 13 of the drive means. In this case the permanent magnet is fixed to the spring 16 to retract the permanent magnet and hence the spindle, the electromotor and latch distally in case of a power interruption.

It is further preferred that the locking device comprises a lock position sensor 24 provided at the frontal end of the housing and having a counterpart 24' provided in a strike plate 25 of the locking device. Such lock position sensor can for example comprise a magnet provided in the strike plate and a RFID tag in the housing, whereby in case the RFID is positioned in front of the magnet, an electric current is generated in the tag.

The RFID tag is in this case electrically coupled to a control unit for activation of the electromotor. Preferably the lock position sensor is comprises a unique key coupling between the part provided in the strike plate and the part comprised in the housing such that accidental or unauthorized activation of the lock position sensor can be prevented.

When in this case the lock position sensor detects the presence of the magnet, a signal is generated and received by the control unit that in turn will activate the electromotor to turn and move the latch out of the housing in a closed position of the locking device (FIGS. 1*b*, 2*b* and 3*b*).

To open the locking device, two options are available. In normal operation, unlocking can be achieved by an external signal (for example from a badge reader) to the control unit, thereby actuating the electromotor to turn and retract the latch (FIGS. 1*a*, 2*a* and 3*a*).

Figure 4A:
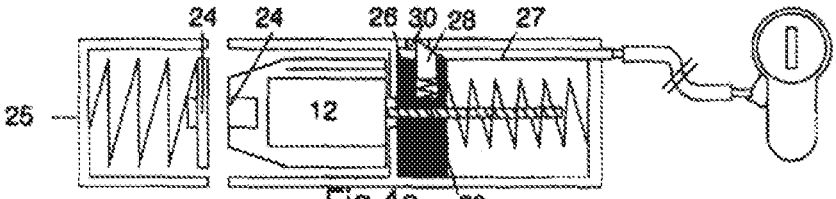
FIGS. 4A-4C schematically represents an alternative embodiment of the locking device in FIGS. 1A-1C in similar positions thereof and whereby the deactivation mechanism.

FIG. 4 represents another alternative embodiment of a lock device according to the invention, whereby the locking device is manufactured as a kit-of-parts. The first part is the actual locking device as depicted in FIG. 4*a*, comprising a tubular housing 1 having a distal end 2 and a frontal end 3. A latch 4 is movable between a first position protruding from the frontal end of the housing (FIG. 1*b*) and a second position retracted in the housing (FIG. 1*a*). Inside the housing, electrical drive means 5 are provided for moving the latch between said first and second positions.

Again, according to the present invention a deactivation mechanism 6 is provided in the housing, allowing movement of the drive means 5 or at least part thereof from an active position (FIGS. 4*a* & *b*) wherein the drive means are enabled to move the latch 4 between the first and second position and a inactive position (FIG. 4*c*) wherein the latch 4 is retracted in the housing irrespective of its movement by the electrical drive means.

In FIG. 4*a*, the deactivation mechanism comprises a plate 26 that is movable in the housing and comprises a threaded hole cooperating with the spindle 13 of the drive means. In this case the plate 26 is fixed to the spring 16 to retract the plate 26 and hence the spindle, the electromotor and latch distally in case the deactivation mechanism is activated.

The deactivation mechanism comprises said plate 26 and a slider 27, said plate 26 comprising a bore hole wherein a pawl 28 is provided that is biased by a spring 29 in a direction wherein the pawl 28 protrudes out of said bore hole thereby cooperating with a slot 30 provided in the inner surface of the housing. The slider 27 is movable in a longitudinal direction between the plate and the housing, between a position wherein it is distant from the pawl 28 extending into the slot 30 and a position wherein the slider forces the pawl inside the bore hole in the plate 26.

When the pawl 28 protrudes inside the slot 30, the plate 26 is prevented from moving backwards in the housing under the force exerted by spring 16, however 16. However, when the pawl 28 is forced inside plate 26, plate 26 will be retracted, thereby deactivating the lock in a same manner as explained supra with reference to FIG. 3.

In FIG. 4*a*, the slider 27 is operated by means of a cable connected to a manually operated lock cylinder.

Figure 4B:
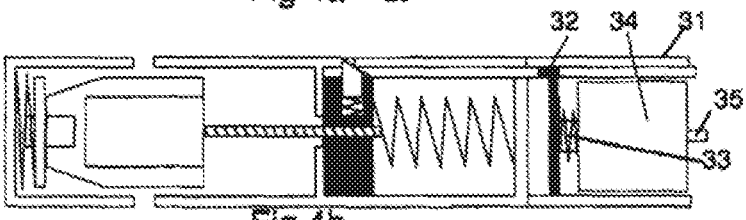

In FIG. 4*b*, a second part (fail safe module) of the kit-of-parts is provided at the distal end of the housing of the first part. The second part comprises electrically driven means cooperating with the deactivation mechanism in the actual locking device to keep the drive means in the active position, interruption of the power supply to the electrical driven means in the second part triggering the deactivation mechanism in the first part causing the drive means to move to the inactive position.

In the present case, the second part comprises a tubular housing 31 connected to the housing of the first part. In said housing 31 of the second part a pivoting pusher 32 is provided cooperating with the slider 27 of the first part of the locking device.

Said pivoting pusher 32 is a fixed to the free end of a rod 33 extending longitudinally in said housing and movable in the axial direction by a solenoid 34 electrically powered through a connector 35.

When the locking device is in a closed position and a power interruption occurs, the rod 33 is forced to move towards the frontal end of the housing by the solenoid 34, thereby pivoting the pusher 32 forward and hence forcing the slider 27 between the housing and the plate 26 in the first part of the lock, such that pawl 28 is forced inside the plate 26 and said plate is retracted in the housing, thereby also moving the spindle, the electromotor and latch distally in case of a power interruption. The movement of the drive means in a distal position will automatically retract the latch in an open position of the locking device as shown in FIG. 4*c*.

Figure 4C:
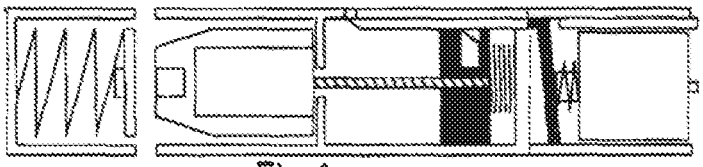

The housings of the first and second part of the kit-in-parts represented in FIGS. 4*b* and 4*c* preferably connected firmly by means of a snap fit ensuring that the pusher 32 and slider 27 cooperate properly.

It is clear that the kit-in-parts as represented in FIG. 4 allows to provide a same locking device in either fail-secure mode (FIG. 4*a*) wherein in case of power supply a lock remains closed unless manually deactivated (the electromotor will not function in case of a power interruption hence the latch will remain in a closed position of the locking device in case of a power interruption) or in a fail-safe mode (FIGS. 4*b* and 4*c*) wherein a deactivation mechanism is provided that is automatically activated in case of a power interruption.

It is clear that due to its tubular housing, due to the axial alignment of the electromotor and the latch in the housing and the distal positioning of the connectors for both the solenoid and the electromotor and/or control unit, installing the locking device is very simple. Indeed, inserting the locking device in a side wall of a door only requires providing a circular hole wherein the locking device can be positioned and subsequently fastened. Moreover the movement enabled by the drive means and by the deactivation mechanism are both oriented in a same direction allowing a very compact housing design.

In order to adjust the position of the lock in view of the distance between the door and the frame a simple sliding of the locking device in the circular hole suffices. Moreover, the lock can be easily mounted in the frame of a door with the strike plate provided in the door itself. Such set up has the additional benefit that the locking device may create an additional anchoring of the frame in a wall thereby strengthening the frame.

The invention claimed is:

1. A locking device comprising:

(a) a tubular housing having a frontal end and a distal end;

(b) a latch movable in a longitudinal direction of the housing between a first position protruding from the frontal end of the housing and a second position retracted into the housing;

(c) an electrically driven drive device configured to move the latch between said first position and said second position; and (d) a deactivation mechanism provided in said housing and configured to allow the drive device to move from an active position, at which the drive device moves the latch entirely in the longitudinal direction from said first position to said second position, to an inactive position, at which the latch is retracted into the housing by a spring biasing the drive device to the inactive position, and said deactivation mechanism is electrically driven to maintain said drive device in the active position against the bias of the springy, under power from a power supply, the drive device moving entirely in the longitudinal direction to the inactive position by the biasing of the spring when power from the power supply to the deactivation mechanism is interrupted.

2. The locking device according to claim 1, further comprising a mechanical actuator configured to actuate movement of the drive device.

3. The locking device according to claim 2, wherein said deactivation mechanism comprises an electromagnet and a permanent magnet that are electrically driven to maintain said drive device in the active position.

4. The locking device according to claim 3, wherein the drive device comprises an electrical motor and a spindle driven by said motor.

5. The locking device according to claim 4, wherein said spindle is coupled to the latch.

6. The locking device according to claim 4, wherein the motor is fixed on the permanent magnet of the deactivation mechanism and to the spring biasing said drive device to the inactive position, such that upon the interruption of the power supply to the deactivation mechanism, the permanent magnet and electromagnet decouple and the drive device is moved by said spring towards the distal end of the housing to the inactive position.

7. The locking device according to claim 1, the drive device comprises a counter-element engaging a free end of a spindle of the drive device.

8. The locking device according to claim 7, wherein said counter-element is coupled to or executed as a magnet of the deactivation mechanism, and wherein said counter-element is biased by the spring and movable between the active and inactive positions of the drive device.

9. The locking device according to claim 1, wherein the housing comprises one or more connectors fir coupling the locking device to the power supply or to a mechanical actuation device, whereby said one or more connectors are positioned at the distal end of the housing.

10. The locking device according to claim 1, further comprising a strike plate comprising a slot configured to receive the latch when the latch is in the first position.

11. The locking device according to claim 10, wherein a reading unit is provided in the housing to determine a position of the housing in view of the strike plate.

12. The locking device according to claim 11, wherein said reading unit is connected to a control unit controlling said drive device.

13. The locking device according to claim 12, wherein the movement of the latch by the drive device and the movement of the drive device to the inactive position are in the same direction.

14. The locking device according to claim 1, wherein the drive device comprises an electrical motor and a spindle driven by said motor.

15. The locking device according to claim 14, wherein said spindle is coupled to the latch.

16. The locking device according to claim 1, wherein the movement of the latch by the drive device and the movement of the drive device to the inactive position are in the same direction.

17. The locking device according to claim 1, wherein said deactivation mechanism comprises an electromagnet and a permanent magnet that are electrically driven to maintain said drive device in the active position.

18. A kit in parts comprising a first part and a second part, the first part is a locking device comprising:

(a) a tubular housing having a frontal end and a distal end;

(b) a latch movable in a longitudinal direction of the housing between a first position protruding from the frontal end of the housing and a second position wherein the latch is retracted into the housing;

(c) electrically driven drive device for moving the latch between said first and second positions; and (d) a deactivation mechanism provided in said housing and configured to allow the drive device to move from an active position, at which the drive device moves the latch entirely in the longitudinal direction from the first position to the second position, to an inactive position, at which the latch is retracted into the housing by a spring biasing the drive device to the inactive position, and the deactivation mechanism is electrically driven to maintain said drive device in the active position against the bias of the spring under power from a power supply, the drive device moving entirely in the longitudinal direction to the inactive position by the biasing of the spring when power from the power supply to the deactivation mechanism is interrupted.

* * * * *